US005161718A

United States Patent [19]

Gueret

[11] Patent Number: 5,161,718

[45] Date of Patent: Nov. 10, 1992

[54] ASSEMBLY FOR DISPENSING AT LEAST ONE LIQUID PRODUCT OR A PRODUCT IN THE FORM OF A CREAM

[75] Inventor: Jean-Louis Gueret, Paris, France

[73] Assignee: L'Oreal, Paris, France

[21] Appl. No.: 683,824

[22] Filed: Apr. 11, 1991

[30] Foreign Application Priority Data

Apr. 13, 1990 [FR] France ..... 90-04829

[51] Int. Cl.[5] ..... B05B 11/04

[52] U.S. Cl. ..... 222/212; 222/494; 222/553; 222/549; 222/556

[58] Field of Search ..... 222/212, 213, 491, 494, 222/548, 549, 553, 556

[56] References Cited

U.S. PATENT DOCUMENTS

| | | | |
|---|---|---|---|
| 3,158,183 | 11/1964 | Brown et al. | 222/213 X |
| 3,204,836 | 9/1965 | Joffe | 222/548 X |
| 3,297,212 | 1/1967 | Neuner | 222/549 X |
| 3,360,169 | 12/1967 | Rinnosuke Susuki et al. | 222/494 X |
| 3,651,998 | 3/1972 | Rocher | 222/548 X |
| 4,141,475 | 2/1979 | Nilson | 222/548 X |
| 4,179,051 | 12/1979 | Thomas | 222/494 |
| 4,314,658 | 2/1982 | Laauwe . | |
| 4,420,101 | 12/1983 | O'Neill | 222/494 X |
| 4,561,570 | 12/1985 | Zulauf et al. | 222/213 X |
| 4,699,300 | 10/1987 | Blake | 222/494 |
| 4,747,518 | 5/1988 | Laauwe . | |
| 5,071,017 | 12/1991 | Stuli | 222/494 |
| 5,099,885 | 3/1992 | Nilsson | 222/494 X |

FOREIGN PATENT DOCUMENTS 1540565 5/1968 France .

*Primary Examiner*—Andres Kashnikow
*Assistant Examiner*—Kenneth DeRosa
*Attorney, Agent, or Firm*—Cushman, Darby & Cushman

[57] ABSTRACT

Assembly (1) for dispensing at least one liquid product or a product in the form of a cream. The assembly comprises a container (2) to which is fixed a distributor head (3) comprising at least one delivery channel. The end of the delivery channel is closed according to the invention by means of a closure system (F) comprising a valve (51) of flexible material which cooperates in the rest position in a non-sealed manner with a fixed rigid seating (41). The valve (51) moves away from the said seating (41) during dispensing by elastic deformation as a result of the pressure of the product to be dispensed, then moves into a position allowing for air recirculation when dispensing is completed. The assembly (1) may comprise, upstream of the closure device (F), a safety device for interrupting the communication between the container (2) and the closure device (F).

9 Claims, 7 Drawing Sheets

ASSEMBLY FOR DISPENSING AT LEAST ONE LIQUID PRODUCT OR A PRODUCT IN THE FORM OF A CREAM

This invention relates to an assembly for dispensing at least one liquid product or a product in the form of a cream. This assembly is particularly advantageous for dispensing cosmetic or pharmaceutical products.

Dispensing assemblies of this type generally consist of a container holding at least one product to be dispensed, to the neck of which is fixed, in a detachable or non-detachable manner, a distributor head and, possibly, a device allowing the user to actuate the said distributor head. The distributor head comprises at least one delivery channel for the product, communicating, on the one hand, with the said container and, on the other hand, with the exterior.

The Applicant has already proposed, in European Patent Application No. 90-400269.8, a dispensing assembly comprising, at the end of at least one channel of the distributor head opening towards the exterior, a closure system consisting of a seal of elastic material which cooperates with a seat in sealed contact when there is no delivery. The said seal moves away from the seat by elastic deformation as a result of the pressure of the product to be dispensed and returns by elastic deformation to sealed contact with the seat when dispensing is completed. For this closure system, the seal and the seat must be in contact over a sufficiently large surface to ensure sealing. A closure system of this kind is aseptic, which is particularly advantageous when dispensing degradable products or products containing no preservatives. However, for numerous products, e.g. sun creams, this asepsis is unnecessary. The said closure system is also used advantageously when the assembly comprises a container consisting of a tube or a deformable flexible pouch or a container comprising a follower piston requiring that there is no recirculation of air. However, if air recirculation is necessary, the distributor head must be provided with an air recirculation valve in addition to the aseptic closure system, as the said closure system does not allow for recirculation of air. This means that the advantage of simplicity is lost as it is necessary to operate two valves.

This invention relates to a valve system which ensures both delivery and air recirculation, but nevertheless prevents any accidental impurities being introduced into the product during dispensing or during storage thereof, e.g. sand in the case of a sun cream. This protection has the advantage that it is effected automatically after dispensing of the product, without the user having to perform any particular action.

This invention relates to an assembly for dispensing at least one liquid product or a product in the form of a cream, comprising a container and a distributor head, the said distributor head comprising at least one delivery channel closed at its end opening towards the exterior by means of a closure device comprising a flexible valve subject to elastic deformation as a result of the pressure of the product to be dispensed and cooperating at rest with a seating, characterised in that the valve cooperates in a non-sealed manner in the rest position with a fixed rigid seating, the said valve moving away from the said seating by elastic deformation as a result of the pressure of the product to be dispensed, then moving into a position allowing for air recirculation when dispensing of the product is completed.

It will be seen that, under these conditions, the valve closes the end of the delivery channel to an extent sufficient to prevent the accidental penetration of impurities therein, but that, as the valve cooperates with the seating in a non-sealed manner, air recirculation is possible.

The assembly according to the invention may also comprise, upstream of the closure device, a safety device for interrupting the communication between the container and the closure device. By virtue of this device, it is possible to transport the assembly without any risk of accidental leakage of the product, although it is not generally necessary to operate it between two successive actuations of the assembly.

According to a preferred embodiment, in the rest position, the valve cooperates edge-to-edge with the seating, the valve moving away from the said seating towards the exterior of the distributor head as a result of the pressure of the product to be dispensed, then towards the interior of the distributor head, into a space formed to this end, in order to allow for air recirculation when dispensing is completed, and finally returning to its rest position when air recirculation is completed.

In this embodiment, as the valve and the seating are in contact edge-to-edge, i.e. over a contact zone defined by the thickness of the valve or the seating, the contact zone at rest is very small and, consequently, there is no sealing. However, this contact is sufficient to close the delivery channel so that no impurities can penetrate into the said channel. In addition, as the valve returns to its rest position by virtue of its own elasticity after air recirculation, closure of the delivery channel requires no special intervention by the user.

The valve is preferably in the form of a disc supported by a rod. The disc is, e.g. circular or oval. The rod can be connected at any point to the disc, but it is preferably connected to the periphery of the said disc, as a valve having suitable elasticity is obtained more easily in this manner. If the rod is connected to the periphery of the disc, then, in a plan view, the disc is advantageously in the shape of the segment of a circle, the rod being connected at the side of the chord defining the said circular segment.

The valve may consist of a thin disc forming part of a component of flexible material and being connected directly to the said component.

According to another embodiment, the valve consists of an elastic nipple provided at the top with a needle-valve cooperating with the rigid seating, the nipple being flattened as a result of the pressure of the product to be dispensed so that the needle-valve releases the seating by translation towards the interior of the distributor head, and returning to its rest position in cooperation with the seating when dispensing is completed.

The rigid seating preferably consists of the edge of an opening formed in the surface of a cap forming the outer surface of the distributor head. The valve advantageously forms part of a component made integral with the cap in the interior of the said distributor head. The opening, the edge of which defines the seating, can be disposed on the axis of the neck, but it is preferably eccentric relative to this axis. In that case, the delivery channel comprises a lateral branch disposed obliquely relative to the axis of the neck of the container, thereby preventing the product to be dispensed emerging via the valve as a result of shock in the event that the container is dropped accidentally.

The rigid seating may also consist of a component comprising a relief forming an open line, the valve forming part of a component of flexible material, at least partly forming the outer surface of the distributor head, and cooperating with the edge of the said relief.

The safety device may be a vertical plug system, i.e. with its axis parallel to the longitudinal axis of the assembly, comprising two concentric skirts having the same axis as the neck of the container, each skirt being provided with an opening, the said openings being disposed so that they can be made to coincide by rotation of one skirt relative to the other. It is also advantageous to use a horizontal plug system as the safety device, i.e. with its axis perpendicular to the longitudinal axis of the assembly. It is also possible to use a pin system, in which a first element comprising a female part and a second element comprising a male part of complementary dimensions can be displaced in translation relative to one another so as to form a channel between the two aforesaid parts in the open position, at least one of these two parts being truncated.

The invention will be more readily understood from the following description of several embodiments of the invention, given purely by means of a non-limiting example and with reference to the accompanying drawings, in which.

Figure 3B:
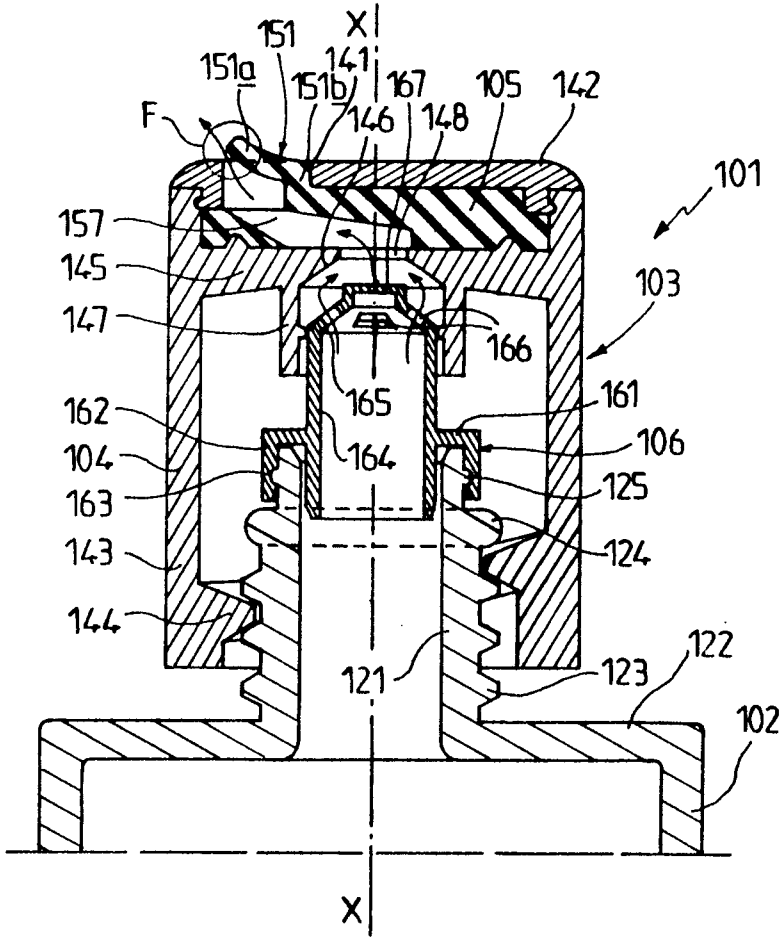
Figure 3A:
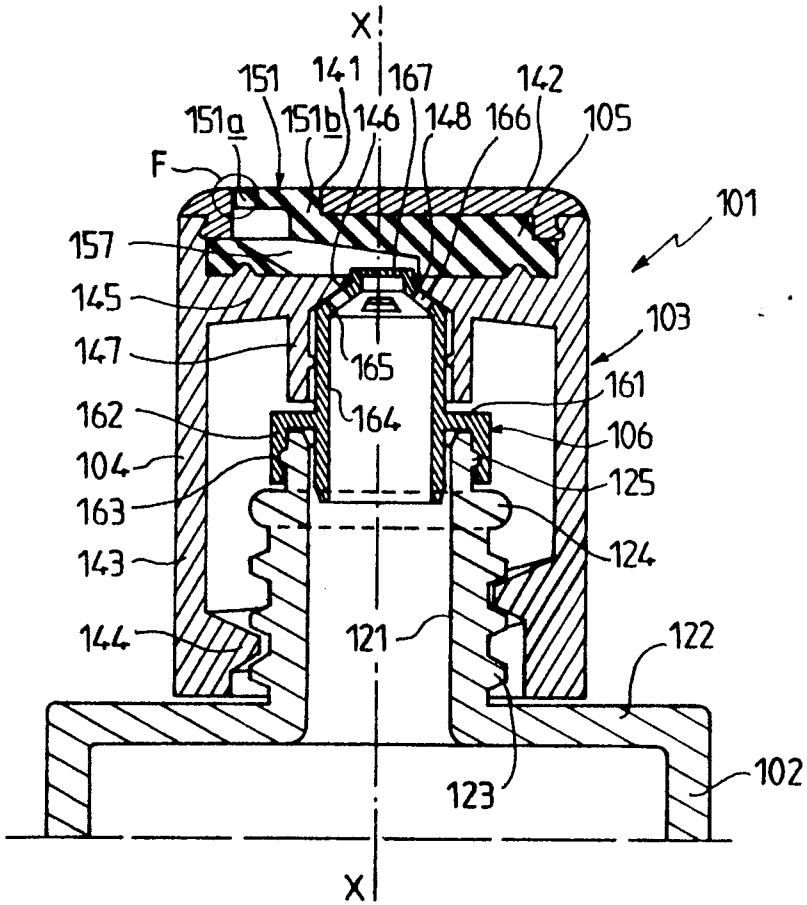
Figure 5:
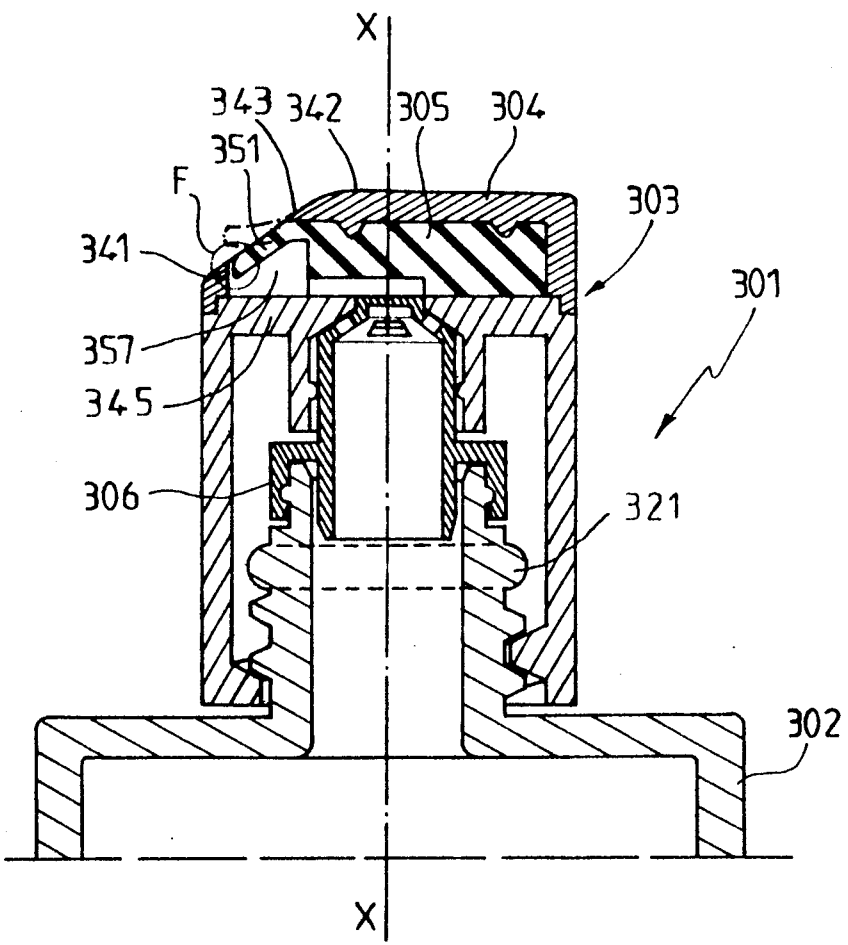
Figure 4:
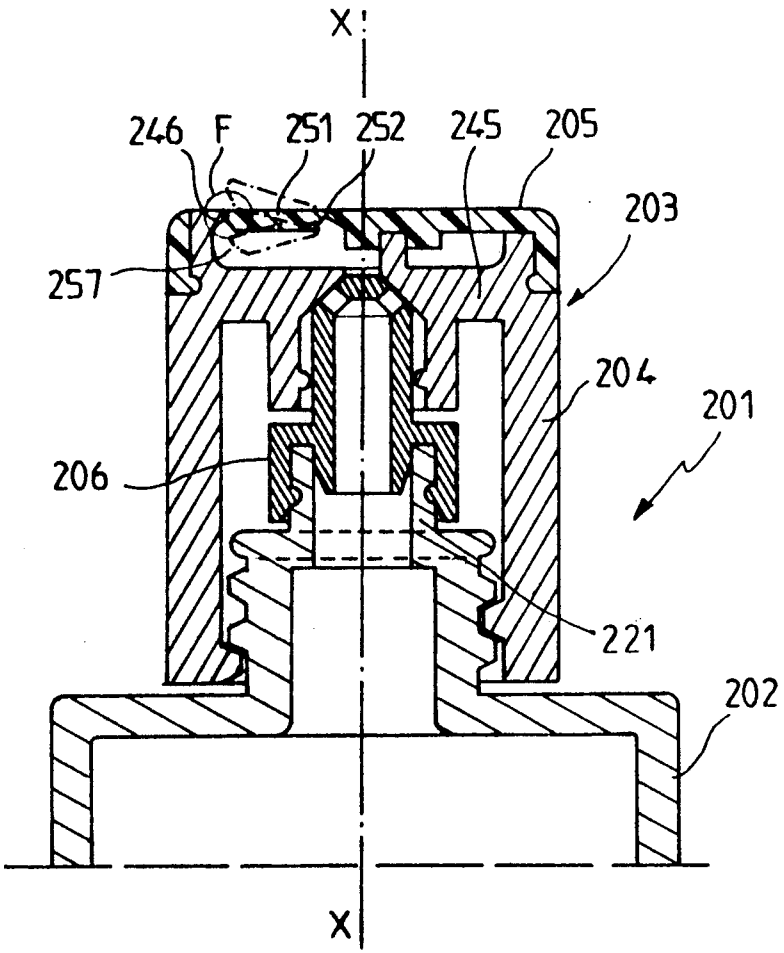
Figure 6:
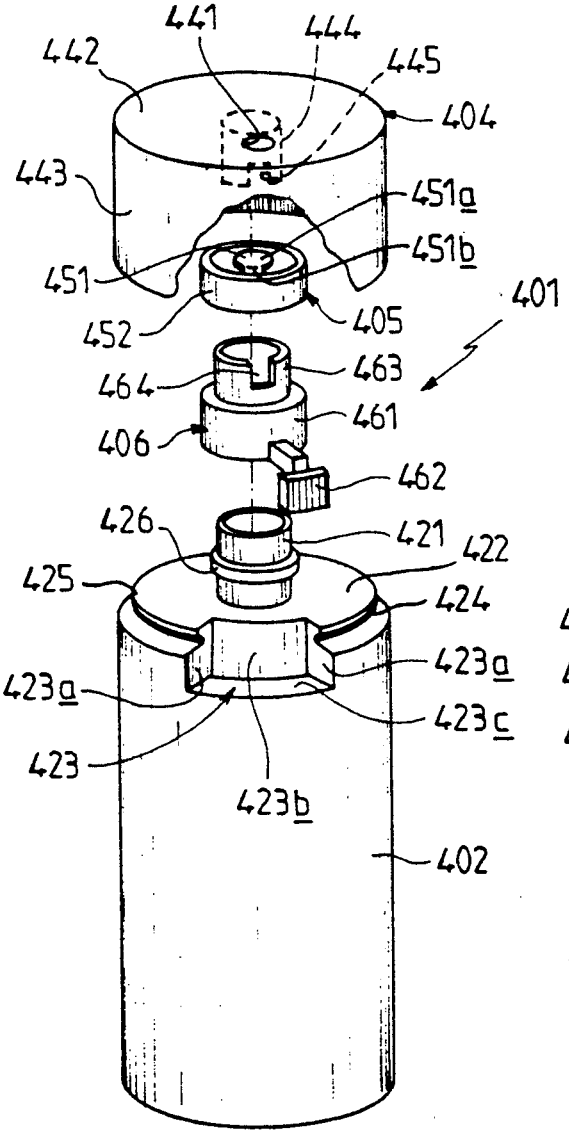
Figure 7:
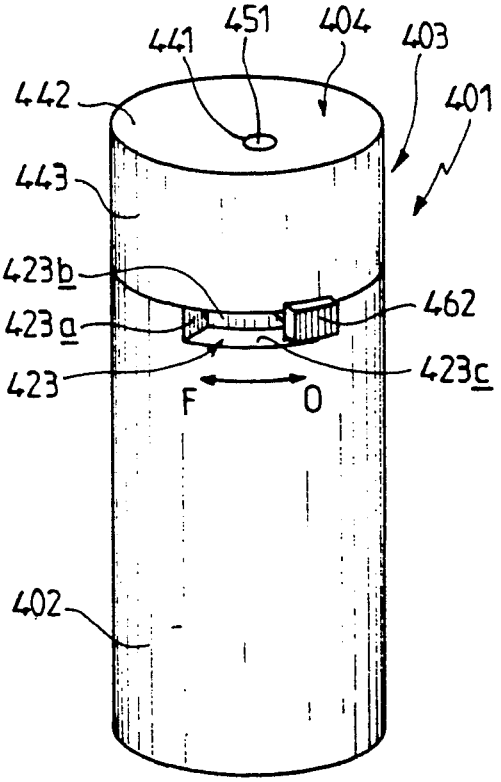
Figure 8:
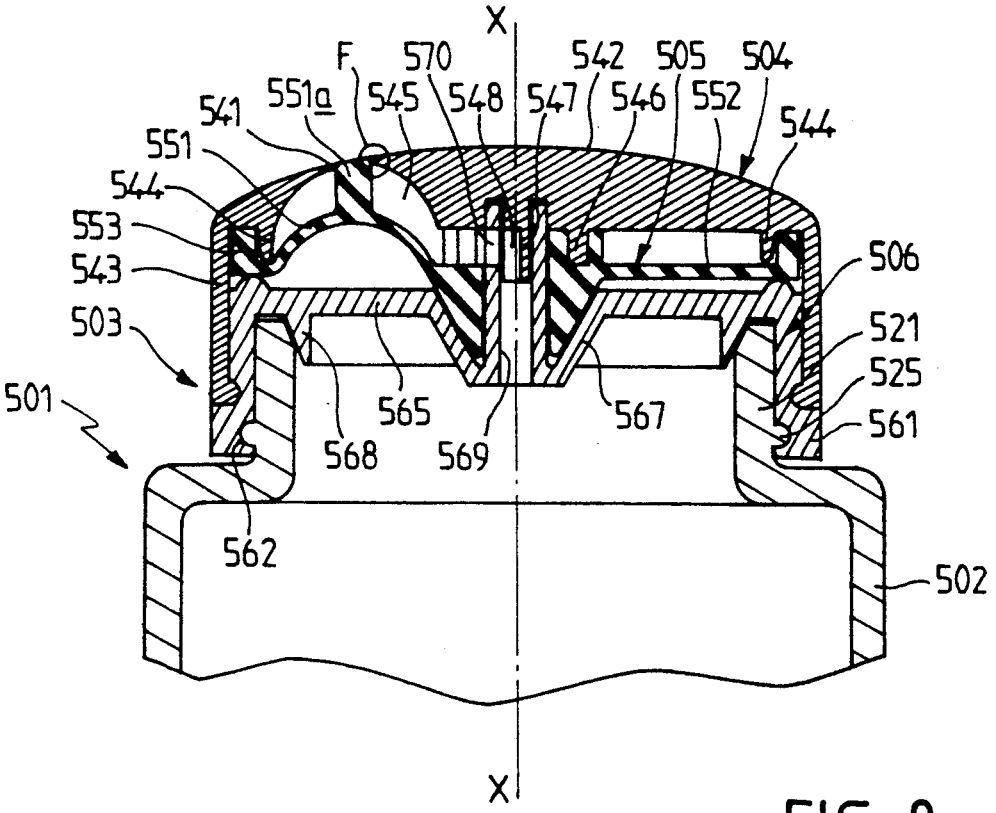
Figure 9:
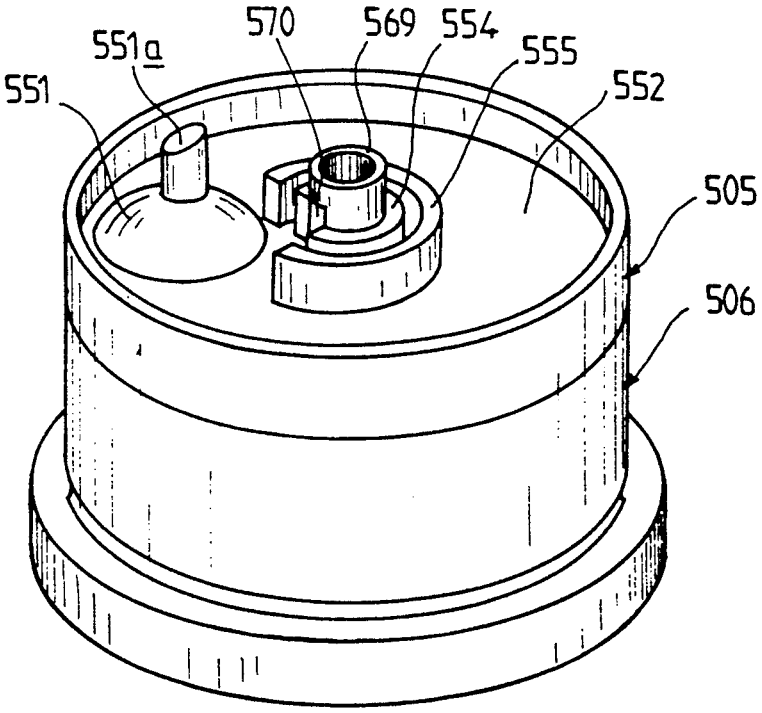
Figure 10:
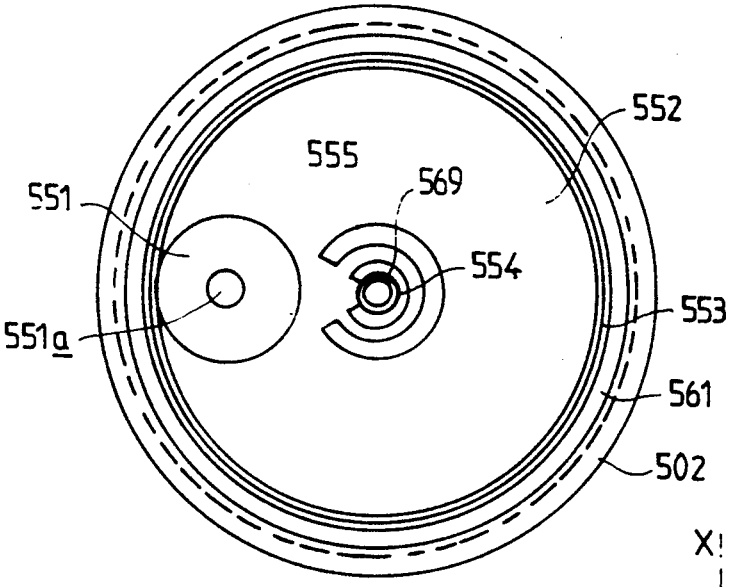
Figure 11:
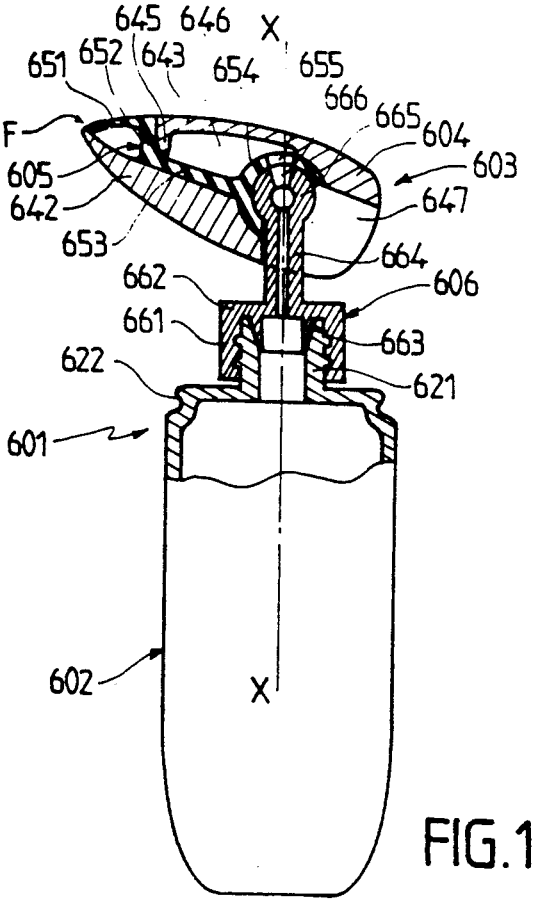
Figure 12:
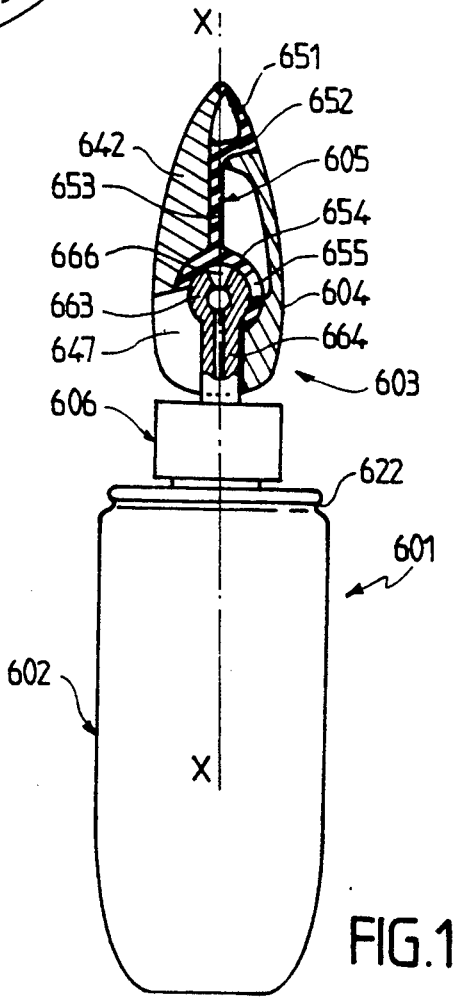
Figure 13:
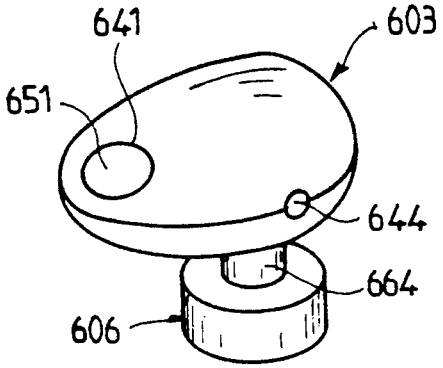
Figure 14:
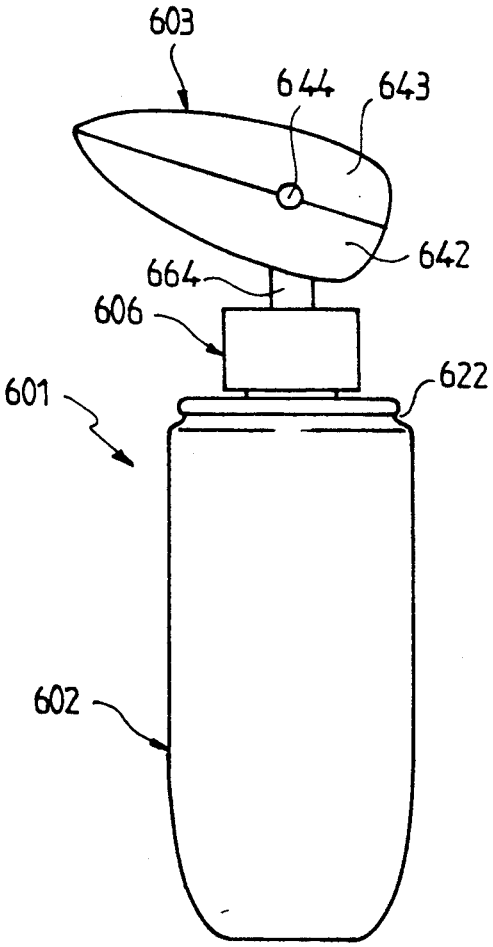
Figure 15:
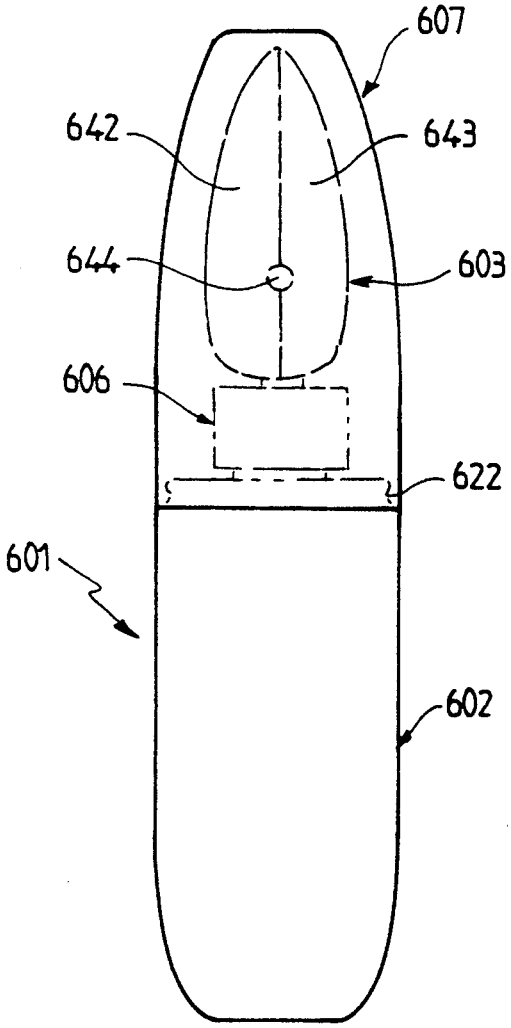

FIGS. 3*a* and 3*b* show diagrammatic longitudinal sections, respectively in the rest position and during dispensing, of a first variant of the dispensing assembly according to the invention;

FIGS. 4 and 5 show diagrammatic longitudinal sections of two other variants of the dispensing assembly according to the invention;

FIG. 6 is a an exploded perspective view of a fourth variant of the assembly according to the invention;

FIG. 7 is a lateral perspective view of the variant of FIG. 6;

FIG. 8 is a partial longitudinal section of a variant of the assembly according to the invention, in which the valve consists of a nipple provided with a needle-valve, the safety device being of the vertical plug type;

FIG. 9 is a perspective view of the distributor head of the assembly of FIG. 8 after removal of the cap;

FIG. 10 is a top view of the distributor head of FIG. 9;

FIG. 11 is a longitudinal section of a variant of the assembly according to the invention, in which the valve comprises a disc and the safety device is of the horizontal plug type, the assembly being in the dispensing position;

FIG. 12 is a view of the assembly of FIG. 11 in the closed position;

FIG. 13 is a perspective view of the distributor head of the assembly of FIG. 11;

FIG. 14 is a lateral view of the assembly of FIG. 11 in the dispensing position, and FIG. 15 is a lateral view of the assembly of FIG. 14 provided with a protective cover.

Figure 1:
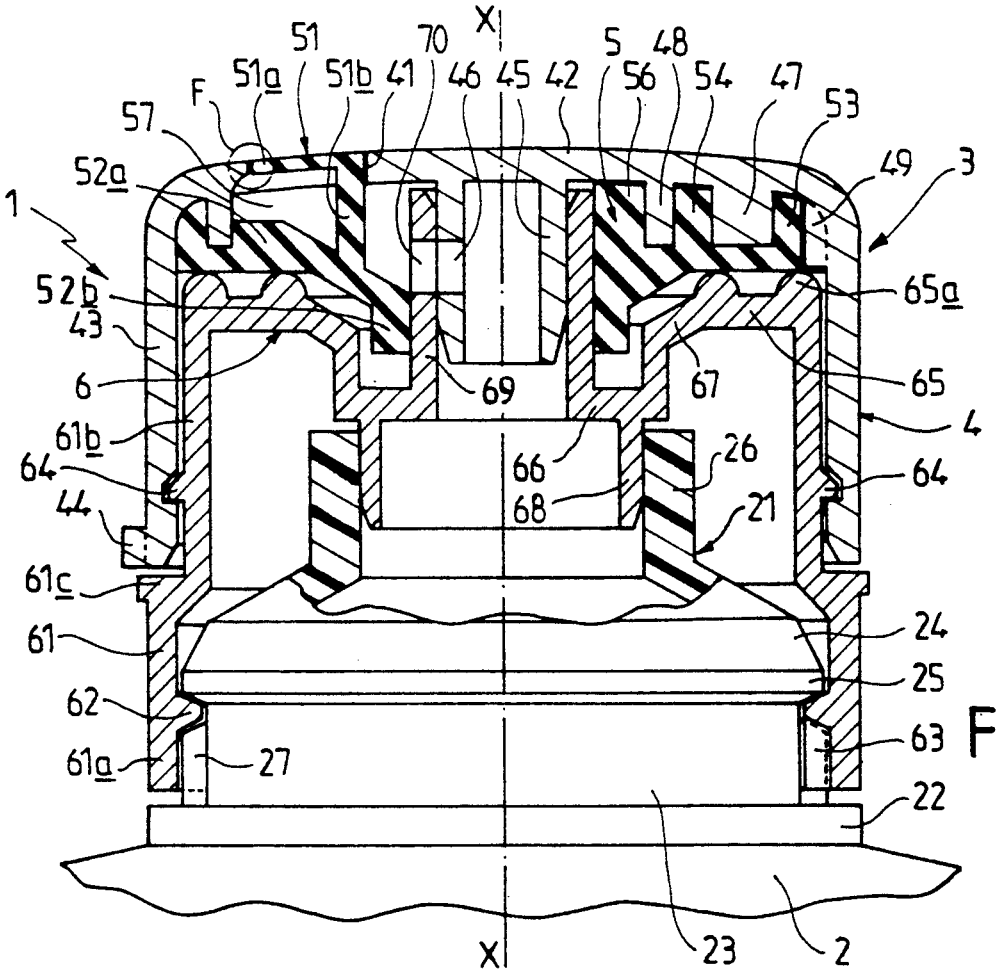
FIG. 1 is a longitudinal section of a dispensing assembly according to the invention.
Figure 2:
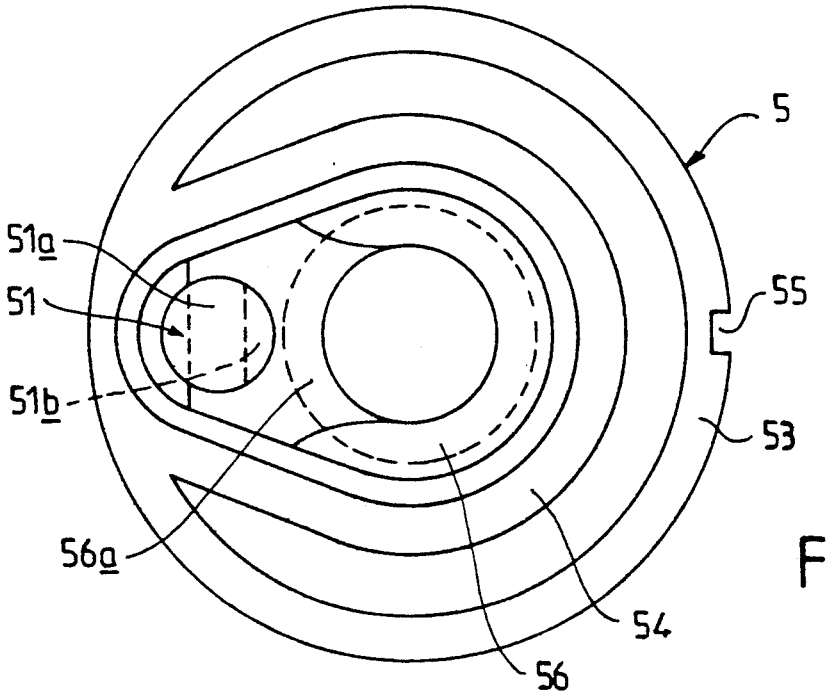
FIG. 2 is a top view of the component of flexible material comprising the valve of the dispensing assembly of FIG. 1.

FIG. 1 shows a dispensing assembly designated by the reference numeral 1. This assembly is composed of a container 2 of flexible plastic material and a distributor head designated in general by the reference numeral 3.

The container 2 consists, strictly speaking, of a flask (not shown) surmounted by a neck 21, disposed above a flat annular shoulder 22. The neck 21 is composed of three successive coaxial portions, a first cylindrical portion 23 provided with radial fins 27, a second portion 24 having a generally truncated shape and forming at its junction with the first cylindrical portion an annular projection 25 having a diameter greater than that of the first cylindrical skirt, and a second cylindrical portion 26 having a smaller diameter.

The head 3 is composed of three elements, an external cap 4 provided on its upper surface (in the position illustrated in FIG. 1) with a circular opening 41, the edge of which serves as a seating for the closure device F, an intermediate component 5 of flexible material provided with a flexible valve 51, and a reducer 6. The reducer 6 is fixed to the neck 21 of the flask, the cap 4 is mounted on the reducer 6 so that it can rotate freely and the component 5 of flexible material is fixed in the cap 4 between the said cap 4 and the reducer 6.

The reducer 6 comprises an outer cylindrical skirt 61 divided into two parts 61*a* and 61*b* connected by means of a shoulder 61*c*. The lower part 61*a* of the outer skirt 61 has an outer diameter equal to the outer diameter of the shoulder 22 of the container 2 so as to form a substantially continuous wall therewith. The skirt 61*a* is provided with an inner flange 62 which fits by snap engagement under the projection 25 of the neck 21 of the flask 2. It is also provided below the flange 62 with fins 63 which cooperate with the fins 27 of the cylindrical portion 23 of the neck in order to prevent rotation of the reducer 6 relative to the neck 21 of the container 2. The upper part 61*b* of the skirt 61 is provided with an outer annular engagement flange 64 for fixing the cap 4 relative to the reducer 6, with free rotation of the cap 4 relative to the reducer 6. The skirt 61 is provided at the upper part of the part 61*b* with a first flat annular collar 65 provided with annular flanges 65*a* directed towards the exterior. The collar 65 is connected to a second flat annular collar 66 disposed in the vicinity of the upper edge of the neck 21 and having a smaller diameter than the collar 65, the two collars 65, 66 being connected to one another by means of a cylindroconical surface 67. An axial cylindrical skirt 68 directed towards the container 2 is disposed below the collar 66, said skirt having an outer diameter equal, except for the necessary clearance, to the inner diameter of the neck 21. A cylindrical skirt 69 provided with an opening 70 is disposed above the inner edge of the collar 66.

The cap 4 comprises a slightly rounded upper surface 42, in which the opening 41 is formed, the said opening being situated outside the axis X—X of the distributor head 3. A cylindrical lateral skirt 43 directed towards the container is connected to the periphery of the upper surface 42. This skirt 43 extends as far as the shoulder 61*c* of the reducer 6. The lower edge of the skirt 43 is provided with a radially raised position indicator 44. The edge of the shoulder 61*c* is provided with reference marks for locating the rotation of the cap 4 relative to the reducer 6. An axial cylindrical skirt 45 having an outer diameter equal, except for the necessary clearance, to the inner diameter of the skirt 69 of the reducer 6 is fixed to the inner face of the upper surface 42. The axial cylindrical skirt 45 is provided with an opening 46 capable of coinciding with the opening 70 of the reducer 6 by virtue of rotation of the cap 4. It will be seen that, in this embodiment, the safety device consists of the two skirts 45 and 69 capable of rotating relative to one another and the openings 46 and 70. Two ribs 47 and 48 adapted to penetrate into grooves of corresponding shape formed in the component 5 in the manner described hereinafter are disposed on the inner face of the upper surface 42 of the cap 4. The lateral skirt 43 is provided with a radial rib 49 which penetrates into a recess 55 in the component 5 of flexible material.

The intermediate component 5 of flexible material consists of a cover having a general annular shape and centred on the axis X—X. This annular cover comprises a substantially flat peripheral portion 52*a* and a central truncated portion 52*b* inclined towards the container. The component 5 is made integral with the inner face of the upper surface 42 of the cap 4 by means of grooves 53 and 54 cooperating respectively with the ribs 47 and 48 of the cap 4. It is provided on its periphery with a recess 55 cooperating with the radial rib 49 of the cap 4. The component 5 rests via its lower face on the bosses 65*a* of the reducer 6. According to an advantageous embodiment, it is provided under the lower face of the portion 52*a* with a flexible radial plate (not shown) which may be positioned in a groove formed in the upper face of the reducer 6 between two parallel radial flanges (not shown). When it moves into position into its groove when the head 3 is rotated, this plate produces a slight snapping sound allowing the user to detect the moment there is movement from the open position to the closed position. In the central zone of its truncated portion 52*b*, the component 5 comprises a cylindrical skirt 56, the wall of which extends from either side of the cover forming the component 5. Above the said cover, the said wall is removed for approximately 150° in order to produce a notch 56*a*. The notch 56*a* opens into a chamber 57 defined laterally by the groove 48 of the cap 4 and the skirt 69 of the reducer 6 and defined in its lower part by the cover of the component 5 of flexible material. The skirt 69 of the reducer 6 is engaged in the interior of the skirt 56, allowing for free rotation of the cap 4 relative to the reducer 6. The opening 46 is opposite the notch 56*a*. Depending on the relative positions of the cap 4 and the reducer 6, the opening 70 of the reducer 6 can be situated opposite the opening 46 and, consequently, can establish communication between the chamber 57 and the interior of the container.

The valve 51 is fixed to the truncated portion 52*b* of the cover of the component 5 and is disposed in the chamber 57. It consists of a disc 51*a* supported by a rod 51*b* connected to the periphery of the disc 51*a*. The disc 51*a* has, in plan, the shape of the segment of a circle, the rod 51*b* being connected along the chord joining together the two ends of the said circular segment. It is disposed in the opening 41 of the cap 4, so that in the zone of its circumference not connected to the rod 51*b* it can cooperate in a non-sealed manner via its periphery with the fixed rigid seating formed by the edge of the opening 41, thereby forming the closure device F.

The device operates in the manner described hereinafter. When the user wishes to dispense the product held in the container 2, he rotates the cap 4 relative to the reducer 6 until the reference marks on the shoulder 61*c* of the reducer 6 indicate that the opening 46 of the skirt 45 of the cap 4 and the opening 70 of the skirt 69 of the reducer 6 are disposed opposite one another. The safety device is open and communication is therefore established between the container 2 and the chamber 57. The user then presses on the container 2 of flexible material. The product to be dispensed passes into the channel defined by the neck 21, and the skirts 68, 69 and 45, passes through the openings 46 and 70 and penetrates into the chamber 57. As a result of the pressure of the product, the disc 51*a* of the valve 51 moves away towards the exterior of the fixed seating formed by the edge of the opening 41 of the cap 4, and delivery of the product begins. When the user stops pressing on the container 2, the wall of the said container tends to return to its initial shape by elastic deformation and a partial vacuum is therefore created in the container 2 and in the chamber 57. The disc 51*a* of the valve 51 is sucked into the said chamber 57, and air penetrates into the container 2. When the container 2 is at atmospheric pressure, the disc 51*a* returns by elastic deformation to its rest position, in which it cooperates in a non-sealed manner with the seating formed by the edge of the opening 41 of the cap 4. The assembly 1 is then closed again and is ready for further use. If the user so wishes, e.g. before travelling, he can close the safety device by rotating the cap 4 in the opposite direction.

FIGS. 3*a* and 3*b* show a variant 101 of an assembly according to the invention, in which a cap 104 is movable in rotation relative to a reducer 106 and in which the safety device consists of a pin system.

The assembly 101 consists of a flask 102 provided with a cylindrical neck 121 disposed on a shoulder 122 of the container 102. The neck 121 is provided with an external thread 123, then a stop flange 124 and finally, in the vicinity of the opening of the neck over a zone of smaller thickness, an engagement flange 125. A distributor head 103 is fixed to the neck 121. It comprises a cap 104, a component 105 of flexible material and a reducer 106.

The reducer 106 consists of a flat annular portion 161 provided on its outer periphery with a cylindrical skirt 162 directed towards the container. The said skirt 162 is provided on its inner wall with a groove 163 cooperating with the engagement flange 125 of the neck 121 of the container 2. An inner skirt 164 is fixed to the inner edge of the annular portion 161 and extends from either side of the said annular portion 161. The skirt 164 has an outer diameter equal, except for the necessary clearance, to the inner diameter of the neck 121 and it is inserted into the said neck 121, the flat annular portion 161 resting on the upper edge of the neck 121. The upper part of the skirt 164 is extended by means of a truncated portion 165 inclined towards the axis of symmetry X—X of the distributor head 103. The truncated portion 165 is provided with openings 166. The truncated portion 165 is closed by means of a circular surface 167 connected to its portion having the smallest diameter by means of a cylindrical wall.

The cap 104 comprises a flat upper surface 142 provided with an opening 141 and fixed by snap engagement to an outer cylindrical skirt 143 which extends in the direction of the shoulder 122 of the container 102. In the vicinity of its lower edge, the inner wall of the skirt 143 comprises a thread 144 which cooperates with the thread 123 of the neck 121. Below the upper surface 142, the skirt 143 is provided with a transverse wall 145 comprising a central circular opening 148. The transverse wall 145 comprises, around the opening 148, a truncated bearing surface 146 formed by the beveled edge of the wall 145. The truncated bearing surface 146 has dimensions complementary to those of the truncated portion 165. The truncated bearing surface 146 is extended towards the container by means of a cylindrical skirt 147 which has an inner diameter equal, except for the necessary clearance, to the outer diameter of the skirt 164 of the reducer 106.

The component 105 of flexible material is disposed in the cap 104 between the upper surface 142 and the transverse wall 145. This component 105 is provided with a hollow chamber 157 into which opens the opening 148 of the transverse wall 145 of the cap and which is disposed under the opening 141 of the upper surface 142 of the cap. At the opening 141, the component 105 comprises the valve 151. This valve consists, firstly, of a part forming a rod 151*b* which is formed by excessive thickness of the component 105 compensating for the thickness of the upper surface 142 of the cap, the rod 151*b* being in contact with the edge of the opening 141, and, secondly, of a disc 151*a*, the edge of which is in non-sealed contact with the edge of the opening 141. The disc 151*a* is capable of moving away, by means of elastic deformation, from the edge of the opening 141 forming the seating, both towards the exterior of the distributor head 103 and towards the interior of the chamber 157 in order to form the closure device F.

The device operates in the manner described hereinafter. When the user wishes to dispense the product held in the container 102, he first opens the pin type safety system formed by the truncated surface 165 of the reducer 106 and by the truncated surface 146. To this end, he rotates the cap 104. By virtue of the thread 123/144, the cap 104 moves upwards in linear translation along the axis X—X. The opening 148 is released from the circular surface 167 that formed the seal and an annular channel is formed between the truncated surfaces 165 and 146, establishing communication, via the openings 166 and the opening 148, between the interior of the neck 121 and the chamber 157. Rotation of the cap 104 is blocked when it comes to a stop against the flange 124.

The user then presses on the container 102. The product emerges from the container, passing through the neck 121, the conduit defined by the skirt 164, the openings 166, the annular space formed between the conical surfaces 165 and 146, at the opening 148 and the chamber 157. As a result of the pressure of the product, the disc 151*a* of the valve 151 moves away by elastic deformation from the edge of the opening 141 of the cap forming the seating. When the user stops pressing on the container 102, the partial vacuum created in the container 102 and the chamber 157 by the resilience of the wall of the container results in air recirculation. As a result of the aspiration of air, the disc 151*a* moves away by flexion towards the interior of the chamber 157. When air recirculation is completed, the disc 151*a* returns to the rest position in non-sealed contact with the edge of the opening 141 forming the seating.

FIGS. 4 and 5 show two variants 201, 301 of a dispensing assembly according to the invention, in which the safety device of the distributor head 203, 303 is of the pin type. In these two variants, the necks 221 and 321 of the container, and the reducers 206 and 306 respectively are identical to those (121 and 106) of the assembly illustrated in FIGS. 3*a* and 3*b*. Only the shape of the component 205, 305 of elastic material and the upper part of the cap 204, 304 are modified with respect to the embodiment of FIG. 3.

In the embodiment illustrated in FIG. 4, the upper surface of the cap has been removed and the component 205 of elastic material is fitted on to a transverse wall 245. The transverse wall 245 comprises a relief 246 forming in its upper part an open curved line which passes through the component 205 of flexible material and thereby defines a valve 251 in the component 205. In order to improve the flexibility of the valve, the base thereof, i.e. the part which is not in contact with the relief 246 and is opposite thereto, is thinned by means of a groove 252. The closure device F is therefore formed by the edge of the valve 251 which is in non-sealed contact with the lateral wall of the relief 246. A chamber 257 is formed under the valve 251.

In the embodiment illustrated in FIG. 5, the component 306 of flexible plastic material is disposed in the interior of the cap 304 between an upper surface 342 and a transverse wall 345. In the embodiment illustrated, the opening 341 is not formed on the upper surface 342, but on an inclined portion 343 of the lateral wall. The valve 351 consists of a disc, which, in the rest position, is inclined so as to be in the plane of the inclined wall 343. This disc is a thinned part of the component 305 so as to obtain a flexible valve. A chamber 357 is formed in the component 306, disposed to the rear of the disc forming the valve.

FIGS. 6 and 7 show an assembly 401 according to the invention, in which the safety system is formed by a vertical plug system consisting of two skirts provided with openings that can be superimposed upon one another and are movable in rotation relative to one another. However, in this embodiment, contrary to the one illustrated in FIG. 1, the cap 404 is fixed relative to the container and the reducer 406 is movable in rotation. The assembly 401 comprises a container 402 of flexible plastic material provided with a neck 421 fixed to a shoulder 422. The lateral wall of the container and the shoulder are provided with a notch 423 projecting into the interior of the container, the lateral walls 423*a* of which are formed by radial planes, the base wall 423*b* by a cylindrical sector and the lower wall by an annular segment 423*c*. A groove 424 provided with an engagement bead 425 is formed at the junction between the shoulder 422 and the container 402. The neck 421 is provided on its exterior with an engagement flange 426 for fixing the reducer 406 of the distributor head 403 so that it is movable in rotation.

The reducer 406 comprises a first skirt 461 and a second skirt 463 separated therefrom by means of a shoulder. The skirt 461 has a diameter such that it can be fixed by snap engagement to the neck 421. The skirt 461 is provided with a control button 462 fixed to a rod which is disposed in the notch 423. The control button 462 just projects from the notch 423. The skirt 463 has a smaller diameter than the skirt 461 and it is provided on its free upper edge with a notch 464. The cap 404 comprises a circular upper surface 442 provided with an eccentric opening 441. An outer cylindrical skirt 443, the lower edge of which is fixed by snap engagement in the groove 424 is disposed on the periphery of the upper surface 442. The lower face of the surface 442 is provided with an inner cylindrical skirt 444, the edge of which is provided with an opening 445. The skirt 444 is attached to the interior of the skirt 463.

A component 405 of flexible elastic material is fixed under the upper surface 442 of the cap 404. It comprises a skirt 452, which surrounds the skirt 463 of the reducer. The valve 451 is a disc 451*a* provided on the upper edge of the skirt 452, the said disc being connected to the skirt by means of a zone of small width forming a rod 451*b*. The disc of the valve 451 is disposed, in the rest position, in the interior of the opening 441 of the cap 404. The chamber formed under the valve 451 between the skirts 452 and 453 communicates with the opening 464 of the reducer 406.

According to this embodiment, in order to open and close the safety device, the control button 462 is actuated between limit positions defined by the radial planes 423*a*. In this manner, the reducer 406 is rotated between an open position in which the openings 464 and 445 coincide and a closed position in which these openings no longer coincide.

According to another preferred embodiment, the control mechanism 462 can be replaced by a roller going around the reducer 406. According to this embodiment, the cap 404 and the flask 402 have a generally oval shape. A notch is provided on the two slightly curved sides of the cap in such a manner that this roller can be operated between the thumb and the index finger of the user.

FIGS. 8 to 10 show a variant of the assembly according to the invention, in which the valve of the closure system consists of an elastic nipple provided with a needle-valve which is flattened as a result of the pressure of the product so that the needle-valve releases the seating by translation, and the safety device is a horizontal plug system. In this variant, the dispensing assembly is designated in general by the reference numeral 501. It is composed of a container of flexible material 502 shown in part in the drawing and a distributor head designated in general by the reference numeral 503. The head 503 consists of three elements, an external cap 504 provided on its upper surface with a circular opening 541 serving as a seating for the closure device F, an intermediate component 505 of flexible material, and a reducer 506. The reducer 506 is fixed to the flask. The intermediate component 505 of flexible material is provided with a valve 551 cooperating with the opening 541. The cap 504 forms an assembly that is movable in rotation about the vertical axis X—X of the neck relative to the reducer 506.

The flask 502 is provided with a neck 521 of a smaller diameter provided with an annular projection 525. The reducer 506 comprises an outer skirt provided on its inner wall with a groove 562, the annular projection 525 of the neck positioning itself therein by snap engagement. A system of fins (not shown) fixed to the neck and to the inner wall of the skirt 561 prevents any rotation of the reducer 506 relative to the neck 521. The skirt 561 is provided in its upper part with a flat annular collar 565 which is connected by means of a truncated surface 567 directed towards the container to an axial shaft 569 provided with an opening 570. An axial cylindrical sealing skirt 568 directed towards the container 502 is disposed below the collar 565 and has an outer diameter equal, except for the necessary clearance, to the inner diameter of the neck 521.

The cap 504 comprises a slightly curved upper surface 542, in which an opening 541 is formed, said opening being situated outside the axis X—X of the distributor head 503. A lateral cylindrical skirt 543 directed towards the container and fixed in rotation by means of a flange/groove system to the outer wall of the skirt 461 of the reducer 506 is connected to the periphery of the upper surface 542. A skirt 544 forming an annular projection having a diameter less than that of the skirt 543 is formed on the inner face of the surface 542. A dome-shaped chamber 545 is formed in the surface 542 around the opening 541, this chamber being tangential to the skirt 544. The inner face of the surface 542 is also provided with a projection 546 in the shape of the arc of a circle open towards the chamber 545, this projection 546 surrounding the shaft 569 and having a diameter greater than that of the said shaft 569. The said inner face is also provided with an axial cylindrical skirt 547 having an outer diameter equal, except for the necessary clearance, to the inner diameter of the shaft 569. An opening 548 capable of coinciding with the opening 570 of the shaft 569 for the dispensing position, by means of rotation of the cap 504 relative to the reducer 506, is formed in this skirt 547.

The intermediate component 505 of flexible material comprises a generally flat annular surface 552 perpendicular to the axis X—X of the head 503. The valve 551 is formed on this flat surface 552 and is in the form of a dome provided with a needle-valve 551*a* capable of closing the opening 541 of the cap 504. The upper part of the needle-valve 551*a* and the edge of the opening 541 form the closure system F. The flat annular surface 552 is bordered at its periphery by a skirt 553 which is inserted between the skirt 543 and the projection 544 of the cap 504. It is also provided with two skirts 554 and 555 each in the shape of the arc of a circle. The skirt 554 consists of the arc of a circle having an inner diameter equal, except for the necessary clearance, to the outer diameter of the shaft 569 and the two skirts 554 and 555 define between them a space suitable for the insertion of the skirt 546 of the cap 504.

The open angle left by the different skirts in the shape of the arc of a circle 554, 546 and 555 is such that the opening 570 of the shaft 569 is free for positioning of the movable sub-assembly 504–505 relative to the fixed sub-assembly 502–506, this position corresponding to dispensing. A projection in the shape of a truncated cone positioned between the truncated wall 567 and the shaft 569 of the reducer 506 is disposed under the flat annular surface 552.

The device 501 operates in the following manner: when the user wishes to dispense the product held in the container 502, he rotates the integral assembly consisting of the cap 504 and the intermediate component 505 relative to the reducer 506 until the opening 548 of the skirt 547 of the cap 504 coincides with the opening 570 of the shaft 569. In this position, the opening 570 is disposed opposite the open angle provided in the concentric skirts 554, 546 and 555. The user then presses on the container 502 and the product held in the container penetrates into the shaft 569 and, after passing through the openings 548 and 570, penetrates into the chamber 545. The product exerts pressure on the dome 551, which is deformed and flattened towards the interior of the chamber 545, thereby moving the needle-valve 551*a* in translation so that it releases the opening 541 of the cap 504. The product can then emerge from the container. When the user stops pressing on the container 502, the product ceases to exert pressure on the dome 551 which returns to its initial shape, the needle-valve 551*a* returning by translation to close the opening 541. The assembly 501 is then closed again. If the user so wishes, he can close the safety device by rotating the cap 504 in the opposite direction relative to the container 502.

FIGS. 11 to 15 show an embodiment of a dispensing device according to the invention, in which the valve is in the form of a disc and the safety device is of the horizontal plug type. In these drawings, the dispensing device is designated in general by the reference numeral 601. It consists of a flexible flask 602 to the neck 621 of which is screwed a distributor head designated in general by the reference numeral 603. The distributor head 603 is formed by the assembly of three elements, a cap 604 comprising a circular opening 641, a flexible intermediate component 605 comprising the valve 651 cooperating with the edge of the opening 641 in order to form the closure system F, and a reducer 606. The reducer 606 is fixed and the assembly formed by the cap 604 and the intermediate component 605 is movable in rotation relative to the reducer 606 about a horizontal axis perpendicular to the vertical longitudinal axis X—X of the dispensing device.

The reducer 606 consists of a cylindrical skirt 661 provided on its inner face with a thread cooperating with a complementary thread of the neck 621 of the flask 602. A flat annular surface 662 is formed on the upper edge of the skirt 66!. This surface 662 is provided on the flask side with a sealing skirt 663 positioned in the interior of the neck 621. An axial duct 664 provided at its end furthest from the flask with a cylindrical plug 665, the axis of which is perpendicular to the longitudinal axis X—X of the dispensing device 601, is disposed on the other face of the surface 662. This plug 665 is provided with a slot 66 diametrically opposite to the duct 664.

The cap 604 is composed of two shells 642 and 643 fitted together by means of snap engagement. When the two shells are assembled, two openings are formed, disposed on the horizontal axis of the plug, pivot pins 644 integral with the ends of the plug 665 being disposed in said openings and guiding the rotation of the flexible sub-assembly (cap 604/intermediate component 605) about the plug 665. The upper shell 643 comprises the opening 641. It comprises an inner projection 645 which serves as a support for the rod carrying the valve 651. A chamber 646 is formed between the two shells 642 and 643. A recess 647 is formed in the lower shell 642, allowing for rotation of the cap 604 between a dispensing position and a rest position. In these two extreme positions, the duct 664 of the reducer 606 comes to rest against the wall of the recess 667. The flexible intermediate component 605 is provided with the disc forming the valve 651 by means of a rod 652 which rests against the projection 645 of the shell 643. It comprises a plate 653 which rests on the inner face of the shell 642. At its opposite end to the one provided with the valve 551, it is provided with an element in the shape of a cylindrical segment 654 having dimensions such that it can rotate about the plug 665. A slot 655 is formed in this element 654, capable of coinciding, by means of rotation, with the slot 666 of the plug 665.

In the rest position, as can be seen in FIG. 12, the sub-assembly (cap 604/intermediate component 605) is disposed vertically. The distributor head 603 can then be protected by means of a cover 607 (FIG. 15) fixed by means of snap engagement to a flange 622 of the flexible flask 602.

When the user wishes to dispense the product, he operates the device in the manner described hereinafter. If necessary, the cover 607 is removed in order to release the distributor head 603. The latter is rotated about pivot pins 644 until the duct 664 comes to rest against the wall of the recess 647.

In this position, the opening 666 is opposite the opening 655 and the flask 602 is in communication with the chamber 646. The user then exerts pressure manually on the flexible flask 602. The product contained in the flask 602 then emerges through the neck 621, and passes through the duct 664 and the openings or slots 666 and 655 in order to penetrate into the chamber 646. As a result of the pressure of the product, the disc 551 of the valve moves away towards the exterior of the rigid seating consisting of the edge of the opening 641 of the cap 604, and delivery of the product begins. When the user stops pressing on the container 602, the wall of the said container tends to return to its initial shape by elastic deformation and a partial vacuum is therefore created in the container 602 and in the chamber 646. The disc 651 is sucked into the chamber 646. Air penetrates into the container and when the container 602 has returned to atmospheric pressure, the disc 651 returns by elastic deformation to its rest position, in which it cooperates in a non-sealed manner with the edge of the opening 641 of the cap 604. If necessary, the user can then close the safety device by returning the distributor head to the vertical position by means of rotation and protect the distributor head with the aid of the cover 607.

I claim:

1. A distributor head assembly, which is attached to a container holding at least one liquid product, such as a cream, for delivering said liquid product comprising:

at least one delivery channel with a first end connected to an opening of said attached container;

a flexible valve, which is a disc supported by a rod, located at a second end of said delivery channel, which flexes into a rest position when said flexible valve is in contact in a non-sealed manner with a fixed rigid seating, which flexes into a dispensing position when said flexible valve is outwardly extended by elastic deformation as a result of a pressure increase of said liquid product, and which flexes into a return position when said flexible valve is inwardly extended into said delivery channel as a result of a pressure decrease of said liquid product in order to allow for air recirculation.

2. A distributor head assembly according to claim 1, wherein a safety device for interrupting the communication between the container and the flexible valve is included.

3. A distributor head assembly according to claim 1, wherein said flexible valve is initially in the rest position and moves away from the fixed rigid seating towards the exterior of the distributor head assembly as a result of the increase in the pressure of the liquid product to be dispensed, then towards the interior of the distribution head assembly into the delivery channel in order to allow for air recirculation when dispensing is completed and returning to the rest position when air recirculation is completed.

4. A distributor head assembly according to claim 1, wherein the rod is connected to a periphery of the disc.

5. A distributor head assembly according to claim 4, wherein the disc, in a plan view, has a shape of a segment of a circle and the rod is connected at a side of a chord defining the segment of the circle.

6. A distributor head assembly according to claim 1, wherein the fixed rigid seating comprises an edge of an opening formed in the surface of a cap which is part of the outer surface of the distributor head assembly.

7. A distributor head assembly according to claim 6, wherein the flexible valve forms part of a component carried by the cap in the interior of the distributor head assembly.

8. A distributor head assembly according to claim 6, wherein the opening, the edge of which defines the fixed rigid seating, is eccentric relative to the axis of a neck of the opening of the attached container.

9. A distributor head assembly according to claim 2, wherein the safety device consists of a system comprising two concentric cylindrical skirts having the same axis as a neck of the attached container, wherein each skirt has an opening which can coincide by rotation of one skirt relative to the other.

* * * * *